United States Patent [19]

Stary et al.

[11] 4,047,572

[45] Sept. 13, 1977

[54] VEHICLE FIRE SUPPRESSION ACCESS PORT

[75] Inventors: William Richard Stary, Peoria; David Merrill Shaw, Pekin, both of Ill.

[73] Assignee: Caterpillar Tractor Co., Peoria, Ill.

[21] Appl. No.: 687,122

[22] Filed: May 17, 1976

[51] Int. Cl.[2] ..... A62C 35/12

[52] U.S. Cl. ..... 169/62; 141/348; 169/70; 285/189

[58] Field of Search ..... 169/62, 46, 70; 239/271, 272; 141/348, 349, 350, 351; 285/9 R, 200, 189

[56] References Cited

U.S. PATENT DOCUMENTS

| | | | |
|---|---|---|---|
| 676,366 | 6/1901 | Koch et al. | 141/349 X |
| 2,857,005 | 10/1958 | Medlock | 169/62 |
| 3,354,508 | 11/1967 | Draben | 285/9 X |
| 3,729,031 | 4/1973 | Baldwin | 141/350 X |
| 3,897,810 | 8/1975 | Arnett et al. | 141/349 X |
| 3,972,373 | 8/1976 | Nichols et al. | 169/62 |

*Primary Examiner*—Evon C. Blunk
*Assistant Examiner*—Michael Mar
*Attorney, Agent, or Firm*—Wegner, Stellman, McCord, Wiles & Wood

[57] ABSTRACT

A fire suppression access port is provided in the various plates, doors or covers of a vehicle for ready application of a fire suppressant to areas of the vehicle behind said plates, doors or covers where a fire might erupt. The access port includes a distortable diaphram through which a fire extinguisher nozzle can penetrate together with a tapered throat for guiding the nozzle into a somewhat sealed condition in the port and a nozzle assembly with a spring loaded cap, which nozzle assembly is directed toward the location where a fire is most likely to start.

10 Claims, 3 Drawing Figures

VEHICLE FIRE SUPPRESSION ACCESS PORT

BACKGROUND OF THE INVENTION

1. Field of the Invention

This invention relates to fire suppression equipment and, more particularly, to a fire suppression access port whereby a fire retardant or suppressant can be directed onto a fire from an outside position.

2. Description of the Prior Art

Practically from the beginning of the development of internal combustion engines and, in particular, the use of such engines for large load applications, such as a tractor or the like, it was common practice to not enclose the engine compartment and, in particular, not to enclose the sides of the engine compartment thereby permitting the surrounding air to assist in cooling the engine during use. Due to the open access to the various elements of the engine, any time any fire started in the engine compartment, either due to a gasoline leak, an oil leak, a hydraulic leak, or a short in the electrical wiring, the operator of the vehicle could immediately put out the fire with a hand-held extinguisher generally carried near the operator's compartment of the vehicle.

In recent years, due to the increased interest in environmental protection, certain voluntary and compulsory regulations have been adopted which require, among other things, that side doors or panels be provided on every vehicle to enclose the engine compartment of the vehicle. Due to the enclosing of the engine compartment of the vehicle, it developed that when a fire did start in and around the engine compartment, it could sometimes be relatively far advanced before the operator of the vehicle became aware of its existence and then, due to the enclosures around the engine compartment, it was impossible for the operator to remove the covers or panels surrounding the engine so that he could gain access to the engine compartment for putting out the fire.

One solution to the problem was to intall fire control equipment in the engine compartment which could be actuated from the operator's cab when the operator became aware of a fire. There are, however, occasions when the fire suppressant equipment becomes exhausted either before the fire is completely out or malfunctions so that it is not possible to extinguish the fire behind the closed panels or hoods of the engine compartment. Usually by the time the operator could get down out of the cab, the panels on the side of the engine compartment are so hot that it is impossible to remove them from the engine compartment. Also, even if the operator could remove the panels, to do so would expose him to the wall of flames which will shoot from the compartment when any panel is removed or opened.

SUMMARY OF THE INVENTION

We have provided ports in the key panels and plates of, for instance, an engine and transmission compartments which ports are readily accessible from the ground by an operator with a hand-held fire extinguisher. The operator inserts the nozzle of the extinguisher through the resilient cover of the port and releases the extinguishing fluid through the port and into the area where the fire is blazing. Almost immediately, the fire suppressant will retard and then extinguish the fire behind the panels. This can be done no matter how hot the panels or plates are and it can be done in complete safety for the operator since he is not exposed to the open flame and the like.

The improved porting arrangement contains a tapered throat behind the resilient cover, which throat wedges the nozzle into a somewhat sealed condition so that the fire suppressant in the extinguisher can be propelled through the throat of the port, through the nozzle, opens the spring loaded cap and is propelled on to the flames in the compartment. When the fire has been extinguished, the extinguisher can be removed from the port, the resilient cover will close the access to the nozzle assembly and, after the panel cools down, the panel can be removed and the damage assessed.

Ports will be provided in any panel or plate on the vehicle where experience has dictated fires are likely to erupt under a given set of circumstances. In this way, by using the appropriate ports, fires in the closed compartments can be extinguished without exposing the operator to any danger from burns or the like.

BRIEF DESCRIPTION OF THE DRAWINGS

The details of construction and operation of the invention are more fully described with reference to the accompanying drawings which form a part hereof and in which like reference numerals refer to like parts throughout.

In the drawings.

DESCRIPTION OF THE PREFERRED EMBODIMENT

Figure 1:
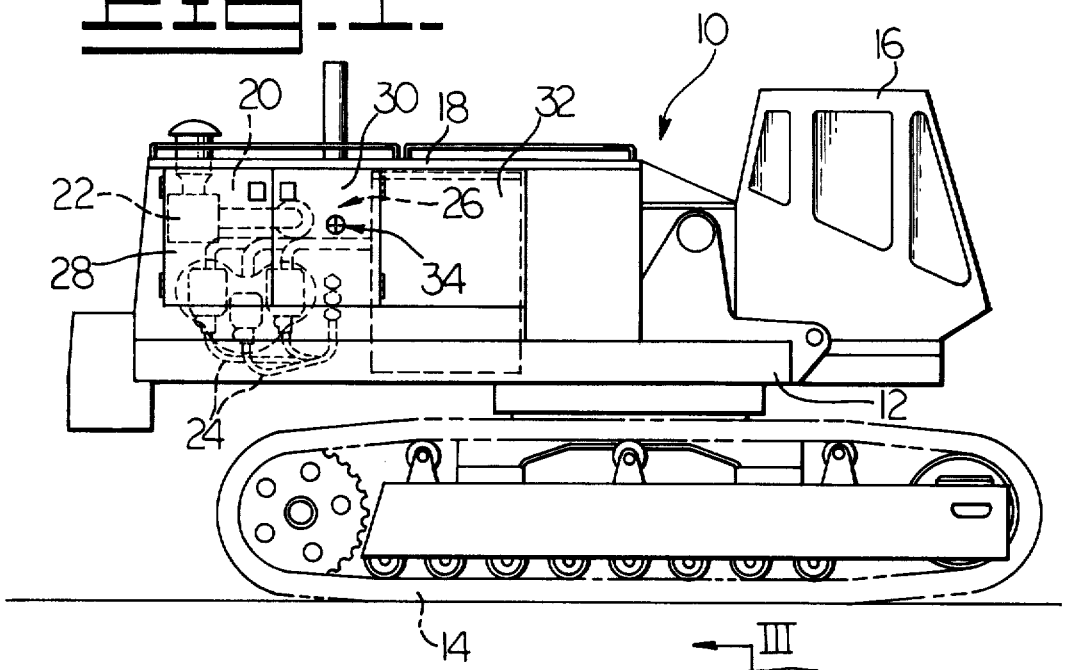
FIG. 1 is an elevational view of a track-type tractor incorporating one of our fire suppression access ports.

In one preferred form of our invention, such as shown in FIG. 1, a track-type vehicle 10 is shown and is comprised of a frame 12, a track 14, an operator's cab 16, and a hood 18 defining an engine compartment 20. As shown in dotted lines in FIG. 1, a turbocharger 22 with various hydraulic lines 24 is located in the compartment 20 in association with an engine 26. Access to the turbocharger 22 and engine 26 is gained through panels 28,30 which are hinged to the frame of the hood 18. Additional panels, such as shown at 32, are also mounted on the frame 12 and enclose other portions of the engine and transmission of the vehicle 10. For illustration purposes, only a single access port 34 is shown in FIG. 1, which access port 34 is mounted in panel 30 and permits access through the port 34 into the compartment containing the turbocharger 22 and the hydraulic lines 24. It is to be understood that an access port 34 could be mounted in the other panel 28, and in panel 32, as well as in several comparable panels on the opposite side of the vehicle. The number of access ports 34 mounted on a vehicle is a matter of choice and completely dependent upon the demands for possible fire control in the various compartments of the engine. It is also to be understood that although the present access port 34 is shown and described herein with respect to a track-type vehicle, such access ports 34 can be used on any vehicle or any stationary equipment where an occasional fire may develop behind an enclosing panel, the purposes being to control any fires that may develop behind the panel without removing the panel.

Figure 2:
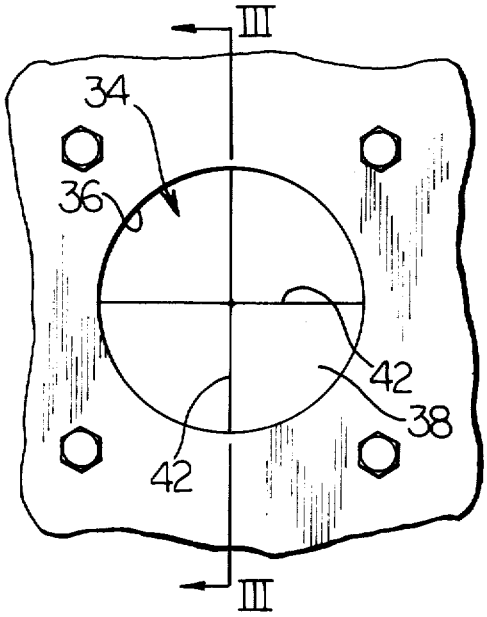
FIG. 2 is an enlarged view of the opening of one of our access ports.
Figure 3:
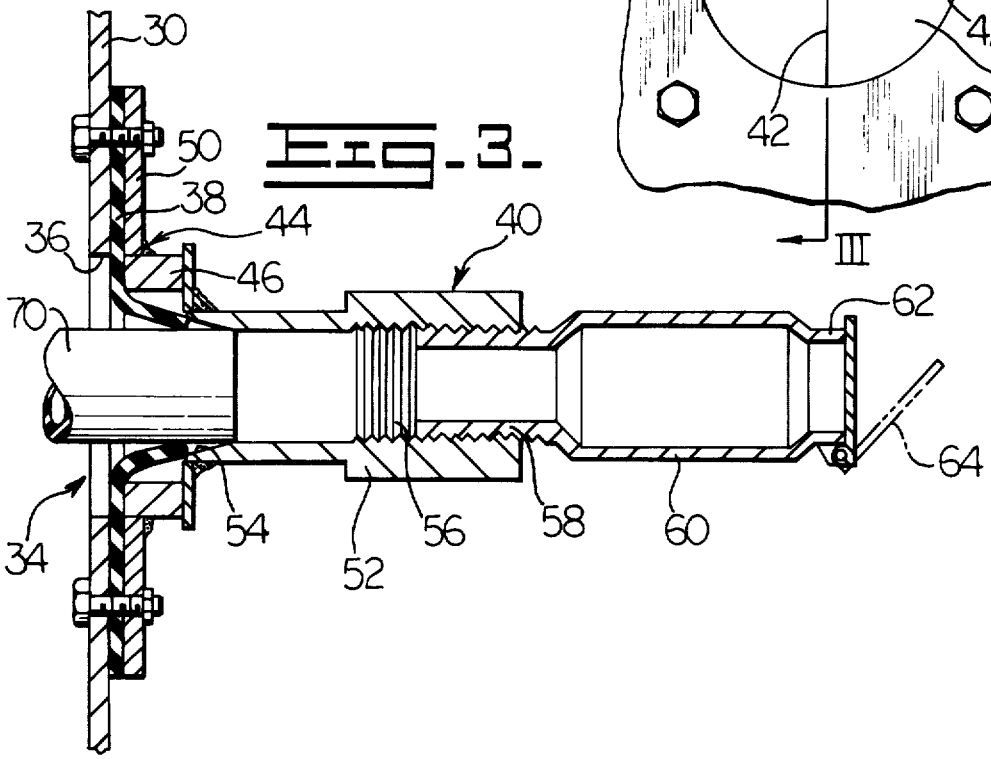
FIG. 3 is a cross-sectional view, taken along the lines 3—3 of FIG. 2, illustrating the details of our invention.

As best shown in the enlarged form in FIGS. 2 and 3, the sheet metal of the panel 30 has an opening 36 cut therein for gaining access to a nozzle assembly 40. The nozzle assembly 40 has a diaphragm 38 of rubber belting, or the like, overlapping the inside edges of said opening 36. The center portion of the diaphram 38 is cross slit at 42, 42 so that pressure at the center of the diaphragm 38 will immediately permit the flaps of the diaphram to yield so that access can be gained therebeyond. A flange member 44, which has a transversely oriented tubular center portion 46 affixed in an opening in the center thereof, is seated against the inside in the diaphram 38 so that bolts 48 pass through the flange 50 of the flange member 44, through the diaphram and through the sheet metal of the panel to secure the diaphram 38 between the flange member 44 and the panel 30. An adaptor 52 is welded to the tubular portion 46 of the flange member 44 and has a tapered throat 54 centrally aligned with the opening 36 in the sheet metal of the panel 30. The projecting end of the adaptor 52, remote from the tapered throat 54, is internally threaded at 56 and receives a threaded nipple 58 of a nozzle 60 therein. The projecting end 62 of the nozzle 60 has a pivoted cap 64 spring urged into position to close the opened projecting end 62 of the nozzle 60.

Although the nozzle 60 is shown as being straight and with the open end 62 projecting in a line transverse to the plane of the panel, it is to be understood that the nozzle 60 can be bent or turned so that the open end 62 of the nozzle points toward an area or at a location most likely to be the source of a fire. In other words, the nozzle assembly 40 will be designed and installed in such a way as to point the nozzle 60 toward the area where a fire suppressant is more likely to be needed.

Using the track-type vehicle, illustrated in FIG. 1, as an example, the turbocharger 22 in the compartment 20 becomes extremely hot in operation and this is particularly true now that the open atmosphere has been closed off from the turbocharger by the doors or panels 28, 30. In the present example, several hydraulic lines 24 are shown passing through the compartment 20 occupied by the turbocharger 22. On rare occasions, one of the hydraulic lines may spring a leak and the hydraulic fluid will begin to accumulate in the compartment. Due to splashing of the hydraulic fluid onto the hot turbocharger 22, or due to the high temperatures in the compartment, the hydraulic fluid can ignite and begin to burn in the enclosure behind the panels 28, 30. The operator of the vehicle can actuate his automatic fire control equipment in an attempt to extinguish the fire. There are occasions when the automatic equipment is not able to control the fire and it becomes necessary for the operator to abandon the cab of the vehicle.

With out improved access ports 34, the operator can approach the vehicle even through the panel doors 28, 30 may be virtually red hot, and can thrust the outlet duct 70 of a fire extinguisher through the diaphram 38 so that the front end of the extinguisher will wedge in the tapered throat 54 of the adaptor 52. Actuation of the fire extinguisher will now propel fire suppressant material through the nozzle and into the compartment 20 containing the fire. The nozzle 60 will direct the fire retardant onto the fire, in this case, onto the blaze around the hot surfaces of the turbocharger 22. After a few short blasts of fire suppressant, the fire is usually extinguished, however, the operator generally will keep the duct 70 of the extinguisher in the access port until the affected area cools down since it is not uncommon for fires of this type to rekindle or reflash, in which case, he can immediately give the extinguisher another shot thereby further suppressing any new flames that may have developed.

After the fire has been extinguished and the panels 28, 30 of the compartment cooled down sufficiently, the panels 28, 30 can be removed and the area surveyed for repair and rehabilitation. Generally, because of the ability of the operator to immediately jump off the vehicle and insert the duct 70 of the extinguisher in the access port 34, it is possible to extinguish a fire of this type before any serious damage has been done to the vehicle. It is then possible to make whatever repairs are necessary to eliminate the cause of the fire and the vehicle is once again ready for use.

We claim:

1. In a fire control apparatus for use in extinguishing fires in a closed compartment, a panel defining one wall of said closed compartment, an access port communicating through said panel into said compartment, said access port comprising a distortable and slotted diaphram covering an opening in said panel, a nozzle assembly aligned with the opening and carried by the panel interior of said compartment whereby fire suppressant directed through the access port and through the nozzle assembly will act to suppress a fire in the compartment.

2. In an apparatus as claimed in claim 1 wherein said nozzle assembly is shaped to direct the outlet of the nozzle assembly toward the area in the compartment most likely to generate an open flame.

3. In an apparatus as claimed in claim 1 wherein a flanged sleeve is bolted to the panel to secure the diaphragm in sealing condition over the opening in the panel and wherein said nozzle assembly includes a nozzle connected through an adaptor to said flanged sleeve.

4. In an apparatus as claimed in claim 3 wherein said adaptor has an inwardly converging tapered portion for guiding the outlet of a fire extinguisher into sealing condition therein.

5. In a fire control apparatus for use in extinguishing fires in a closed compartment, said closed compartment containing a source of fire, panel means carried by a wall of said compartment for use in gaining access to said compartments, an access port carried by one of said panel means, said access port comprising an opening through the panel, is distortable diaphram covering the opening in said panel, a flanged sleeve bolted to the panel to secure the diaphram in sealing condition over the opening in the panel, an adaptor secured to said sleeve and a nozzle connected to said adaptor and having an outlet pointing into said closed compartment whereby a fire suppressant may be directed through said access port into said compartment.

6. In a vehicle having an engine with auxilliary equipment operatively connected thereto, panel means for enclosing a compartment containing said engine and said accessory equipment, an access port carried by one of said panel means, said access port comprising an opening through said panel means, a distortable diaphram covering the opening in said panel means and, a nozzle assembly aligned with the diaphram and the opening and carried by the panel means whereby fire suppressant may be directed through the diaphram and through the nozzle assembly into said compartment.

7. In a vehicle as claimed in claim 6 wherein said nozzle assembly is shaped to direct the opening of the nozzle assembly toward the area in the compartment most likely to generate an open flame.

8. A vehicle as claimed in claim 6 wherein a flanged sleeve is bolted to the panel to secure the diaphram in sealing condition over the opening in the panel and wherein said nozzle assembly comprises a nozzle connected through an adaptor to said flanged sleeve.

9. In a vehicle as claimed in claim 8 wherein said adaptor has an inwardly tapered portion for guiding the outlet of a fire extingisher into sealing condition therein.

10. In a vehicle as claimed in claim 8 wherein said nozzle has a spring urged cap for closing the outlet opening of the nozzle, said cap being opened against the urging of the spring under the pressure of the fire suppressant.

* * * * *